US005779505A

United States Patent [19]

Yagi et al.

[11] Patent Number: 5,779,505

[45] Date of Patent: Jul. 14, 1998

[54] ELECTRICAL CONNECTOR TERMINAL AND METHOD OF MAKING ELECTRICAL CONNECTOR WITH SAME

[75] Inventors: Masanori Yagi, Ebina; Masahiro Shiga, Yamato; Toru Maruyama, Kawasaki, all of Japan

[73] Assignee: Molex Incorporated, Lisle, Ill.

[21] Appl. No.: 489,470

[22] Filed: Jun. 12, 1995

[30] Foreign Application Priority Data

Jul. 19, 1994 [JP] Japan ..... 6-188973

[51] Int. Cl.[6] ..... H01R 13/405

[52] U.S. Cl. ..... 439/736; 439/722; 439/660; 29/883

[58] Field of Search ..... 439/83, 736, 637, 439/660, 606; 29/874, 883, 884, 722

[56] References Cited

U.S. PATENT DOCUMENTS

| | | | |
|---|---|---|---|
| 3,348,191 | 10/1967 | Kinkaid | 439/637 |
| 4,106,841 | 8/1978 | Vladic | 339/176 |
| 4,501,465 | 2/1985 | Hoshino et al. | 439/736 |
| 4,863,402 | 9/1989 | Black et al. | 439/736 |
| 4,865,562 | 9/1989 | Burg et al. | 439/736 |
| 5,176,541 | 1/1993 | Mori | 439/736 |
| 5,350,322 | 9/1994 | Kondo | 439/736 |

FOREIGN PATENT DOCUMENTS

| | | | |
|---|---|---|---|
| 2-273487 | 11/1990 | Japan | H01R 43/24 |

OTHER PUBLICATIONS

IBM Technical Disclosure Bulletin vol. 6 No. 4 Sep. 1963, pp. 29 & 30, "Expandable Terminal Insert Strip".

*Primary Examiner*—David L. Pirlot
*Assistant Examiner*—Tho Dac Ta
*Attorney, Agent, or Firm*—James C. Paschall; Charles S. Cohen

[57] ABSTRACT

An improved electrical connector has terminals with tapered mold engaging ends formed to be complimentary in shape to notches made in a mold component in order to retain the pitch of the terminal ends during injection molding of a connector housing thereabout.

17 Claims, 6 Drawing Sheets

ELECTRICAL CONNECTOR TERMINAL AND METHOD OF MAKING ELECTRICAL CONNECTOR WITH SAME

BACKGROUND OF THE INVENTION

The present invention relates to terminals used in electrical connectors and a method of making electrical connectors, and more particularly to an improved terminal assembly of reduced pitch which assures reliable arrangement during mounting in an associated connector housing, as well as a method of making electrical connectors using such terminals.

As is well known, electrical connectors are used to connect different electrical components to each other, and wires to printed circuit boards in various electrical apparatus. Such connectors are of multi-pole or terminal structure and use a plurality of terminals laterally arranged at regular intervals and fixed to the housing of the connector. Each terminal typically has a solder tail portion extending from the base of the housing for soldering to an associated wire or electrical trace or contact pad.

In making such connectors, a plurality of terminals may be either press-fitted in corresponding holes of a connector housing, or may be embedded in the housing during injection molding of the housing. Specifically, a plurality of terminals may be integrally connected in series to an associated lateral carrier strip, and the series is either press-fit into the connector housing or embedded as a whole in the housing by injection molding an insulative material, such as a plastic, therearound. Finally, the lateral carrier strip is cut and separated from the terminals thus press-fitted or embedded in the housing.

In the injection molding of connector housings, inner and outer molds are used to define a mold cavity and a series terminal-arrangement is inserted therebetween, so that an insulative housing may be molded with the series terminal-arrangement embedded therein. Then, the inner and outer molds are removed and the carrier strip is cut and removed to provide an electric connector.

Undesired irregular arrangement of terminals, however, may occur in press-fitting terminals into the holes of a housing or when inserting them into a mold cavity where terminals and the inner and outer molds are potentially misaligned relative to each other. The terminals are very thin and small, and therefore, they are prone to being misaligned or bent. As the pitch of the terminals (i.e., the spacing between adjacent terminals) decreases, the potential for misalignment during assembly of the terminals into a connector housing increases.

In an attempt to reduce such problems, some proposals have been made for the manner of press-fitting or for special jigs for setting terminals in molds and special designed molds. Such proposals are satisfactory to some extent in improving precision of products, but they require extra steps and complicated or time-consuming work. Accordingly the manufacturing cost increases, and the manufacturing efficiency decreases.

SUMMARY OF THE INVENTION

It is therefore an object of the invention to provide electrical connectors in which the terminals are substantially free of the disadvantages described above, assuring the exact positioning of terminals in their associated connector housings and attaining substantial improvement of production thereof.

Another object of the invention is to provide a method of making electrical connectors using terminals having a very small pitch.

To attain these objects, a group of terminals are laterally arranged at regular intervals and connected to a lateral carrier strip via joint portions and contained within an insulative housing. Each terminal has a tapered end at the side opposite to the side on which the terminal is connected to the lateral carrier strip. This tapered end may converge toward the centerline of the terminal, thus defining two opposing angled, or slanted, surfaces extending from the opposite parallel sides of the terminal rectangular body.

An electrical connector comprising an insulative housing and a group of terminals arranged at regular intervals and mounted to the housing, is therefore improved according to the present invention in that each terminal has a contact portion, a first end at one end thereof and a mold engagement portion at the other end thereof, the engagement portion having a tapered end.

In mounting a plurality of terminals in a connector housing, the arranging of such terminals at reliable and exact intervals can be attained by using appropriate jig means in the form of specially configured mold components having notches arranged at regular intervals corresponding to the desired intervals between the terminals and at which the terminals are to be arranged when fixed in the connector housing. The jig means is used to keep all terminals arranged at exact intervals by interdigitally nesting the tapered ends of the terminals with the notches of the jig means. Thus, irregular arrangement of terminals may be substantially reduced once these terminals are put in the jig means.

Such jig means may be provided in the form of a series of notches in one of the connector housing mold components. The arrangement of terminals are secured between the inside and outside mold components or blocks with the tapered end of each terminal fitted in the corresponding notch in the appropriate mold part prior to injection molding, thereby assuring arrangement of all terminals at exact intervals.

The present invention also leads itself to a method of making electrical connector, which includes the steps of: providing interengaging mold components that form a cavity for molding insulative connector housings; placing a group of terminals into the mold cavity defined by the mold components; injection-molding an insulative material into the mold cavity and about a portion of the group of terminals, then removing the mold components to expose an electrical connector having the group of terminals arranged at regular intervals and embedded in the insulative connector housing. Such a method is improved according to the present invention in that one of the mold components is provided with a series of notches formed therein at regular intervals corresponding to those at which the group of terminals are to be arranged; the group of terminals are integrally connected to an associated carrier strip, each terminal having a tapered end complementary in shape to the notch made in the appropriate mold component; and the group of terminals are put between the interfitting mold components with the tapered free-end of each terminal fitted in the mold component notch prior to injection molding, thereby assuring arrangement of all terminals at exact intervals.

Other objects and advantages of the present invention will be understood from the following description of a preferred embodiment of the present invention.

BRIEF DESCRIPTION OF THE DRAWING

In the course of the following detailed description, reference will be made to the attached drawings wherein like reference numerals identify like parts and wherein.

DETAILED DESCRIPTION OF THE PREFERRED EMBODIMENTS

Referring to FIGS. 1–6, an electrical connector is shown as a receptacle housing with a central elongated space 9 and a plurality of terminals 3 arranged at regular intervals P in its insulative housing 1. Specifically, all of the terminals 3 are arranged laterally at regular intervals P in the central space 9 defined by opposite side walls 19 and 20 of the connector housing. This central space 9 is adapted to receive a mating electrical connector, that is, a plug housing (not shown) for establishing a required electrical connection between the two connector components.

As the trend for reduction in size of consumer electronics grows, the need for connectors of reduced size likewise increases. One way to reduce the overall size of electrical connectors is to reduce the pitch of the connectors, that is, the spacing between adjoining connector terminals. By reducing the pitch, a connector of a given size may accommodate more circuits. The reduction in pitch down to 0.625 mm and the like typically necessitates a reduction in the size of the terminals. As the size of the terminals decrease, the fragility of the terminals increases and the potential for misalignment occurring after the stamping of the terminals increases. Although in a stamping and forming process, the terminal tail portions which extend out from a carrier strip are secured in a predetermined position which can maintain the pitch at that position, the free ends, in this case the engagement portions, are not. The present invention is directed to a solution for this problem.

Figure 1:
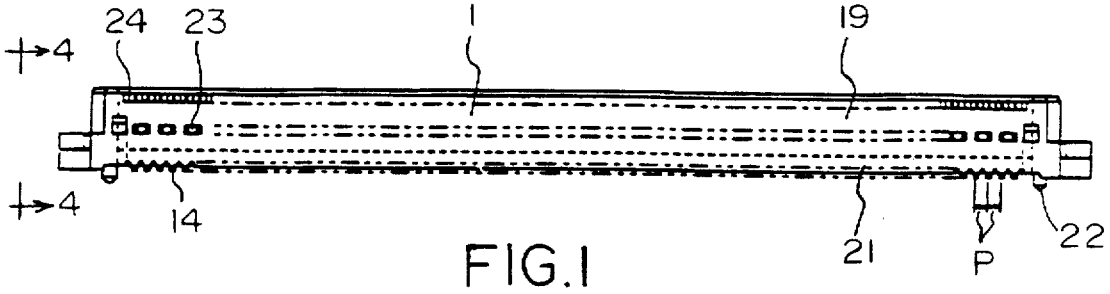
FIG. 1 is an elevational view of an electrical connector constructed in accordance with the principles of the present invention.
Figure 2:
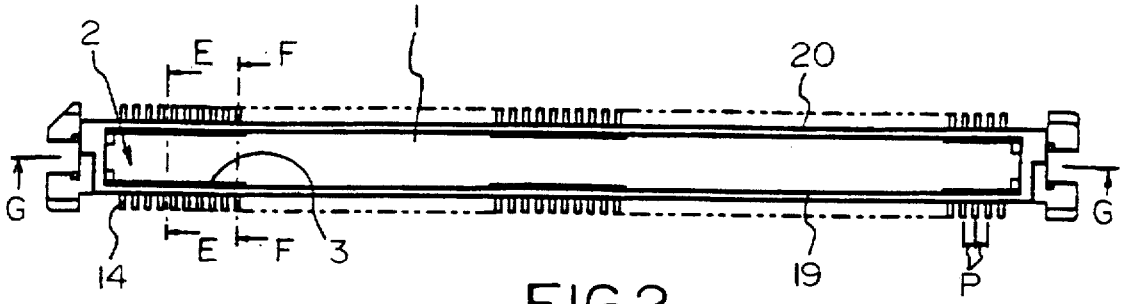
FIG. 2 is a top plan view of the electrical connector of FIG. 1.
Figure 3:
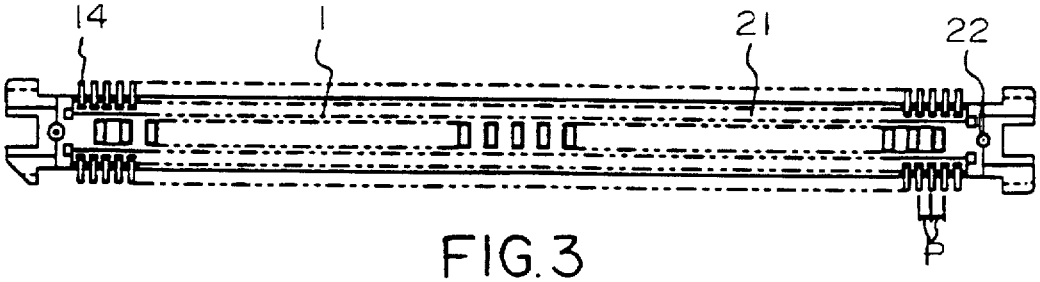
FIG. 3 is a bottom plan view of the electrical connector of FIG. 1.
Figure 4:
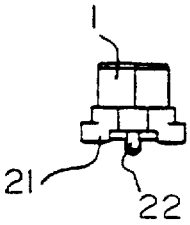
FIG. 4 is an end view of the electrical connector of FIG. 1 taken along lines 4—4 thereof.
Figure 5:
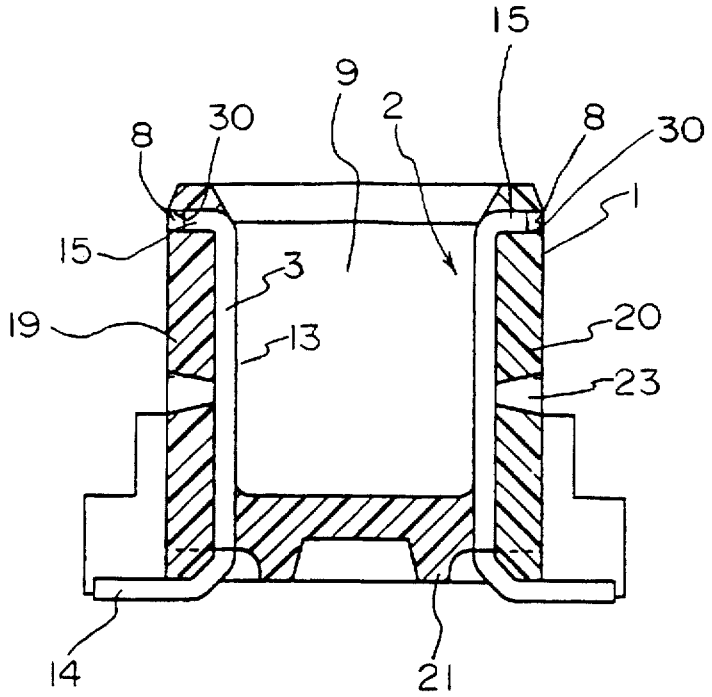
FIG. 5 is a cross sectional view of the electrical connector of FIG. 2 taken along the line F—F thereof.
Figure 6:
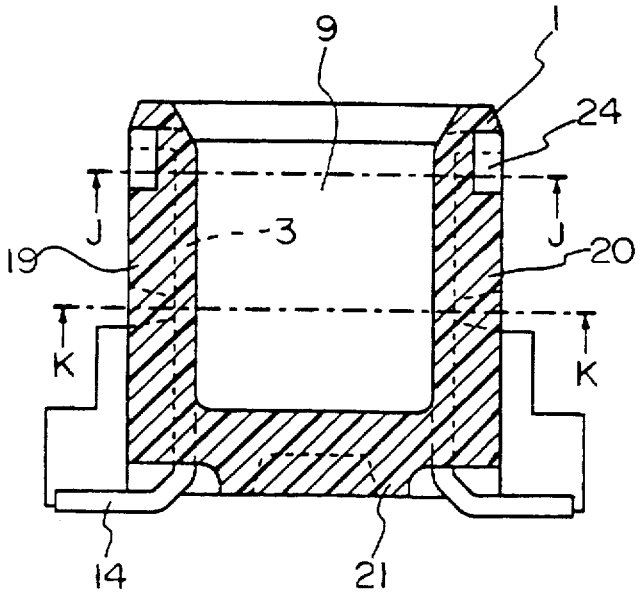
FIG. 6 is a cross sectional view of the electrical connector of FIG. 2 taken along the line E—E thereof.
Figure 7:
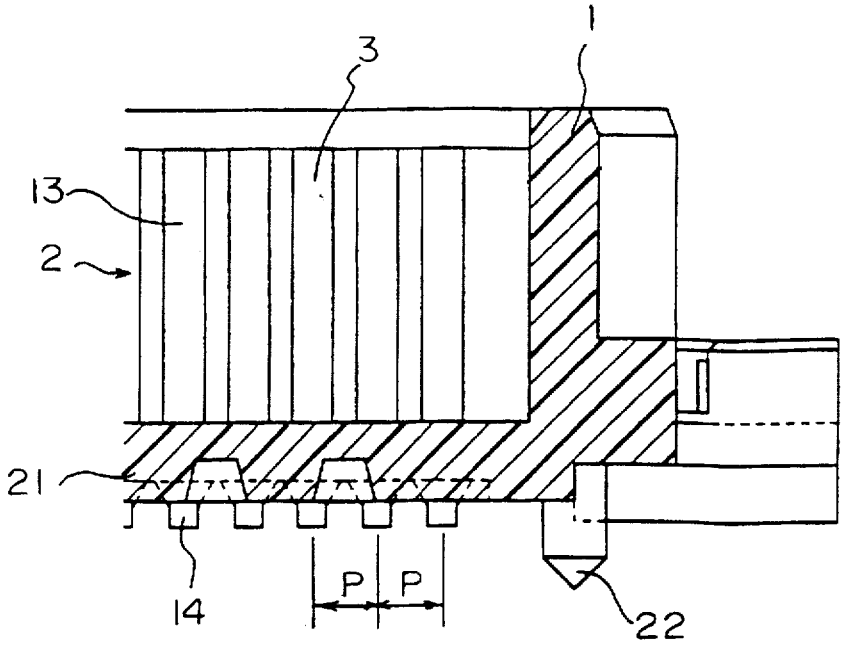
FIG. 7 is a longitudinal section of a portion of electrical connector of FIG. 2 taken along the line G—G thereof.

Referring now to FIGS. 5–7, it can be seen that each terminal 3 is composed of an elongated contact portion 13, a solder tail portion 14 connected to one end of the contact portion 13 and extending outwardly therefrom. A mold engagement portion 15 is connected to the other end of the contact portion 13 and is set within the connector housing sidewalls 19, 20. The contact portion 13 is exposed along the central space 9 of the housing 1, and serves to provide contact with an opposing terminal of the plug housing. The solder tail portion 14 extends out of the bottom 21 of the housing 1. Finally, the mold engagement portion 15 is situated in a recess 30 made in the top of the housing 1. As shown, a portion of each terminal 3 is embedded in the housing 1.

Figure 11:
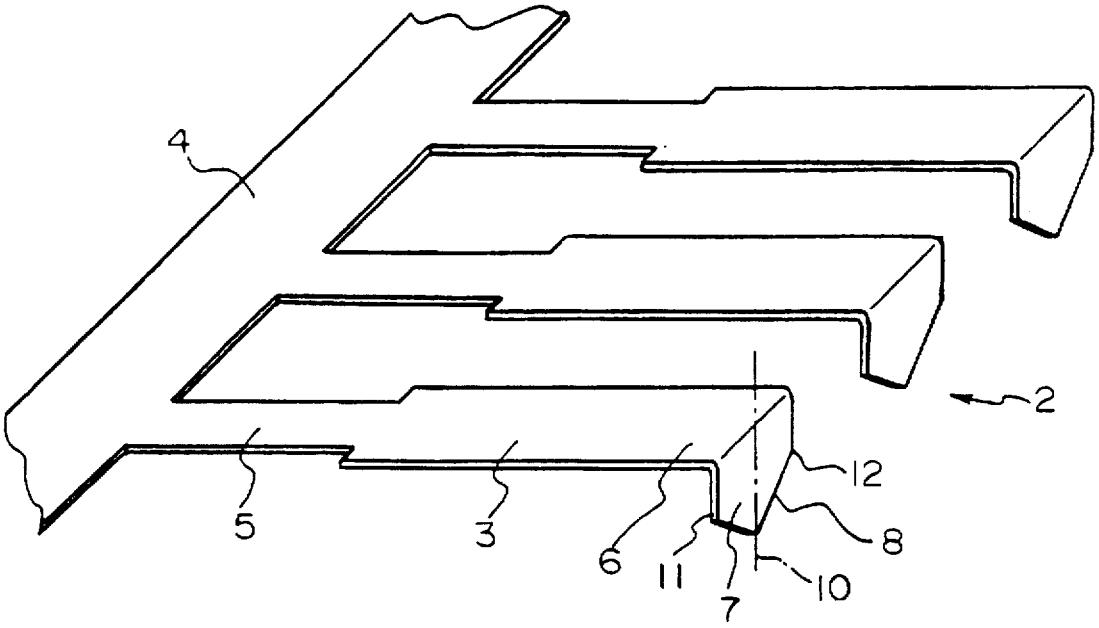
FIG. 11 is an enlarged perspective view of a portion of the group of terminals integrally connected to their lateral carrier strip.
Figure 12:
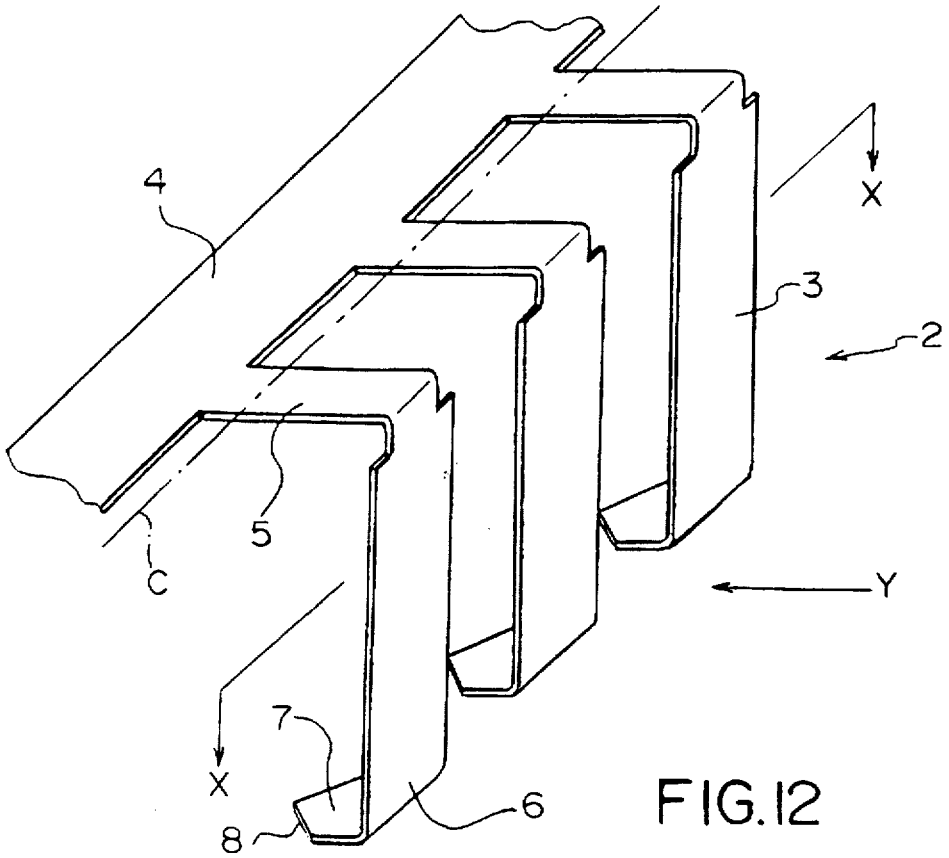
FIG. 12 is a perspective view of a portion of the group of terminals connected to a carrier strip, showing how they are placed into a mold cavity between inner and outer mold blocks.

Prior to the mounting of terminals 3 to the housing 1, these terminals 3 exist in a form wherein they are connected to a lateral carrier strip 4 via joint parts 5 (FIGS. 11 and 12) to define a series arrangement of terminals 2 which have a predetermined pitch P. The carrier strip-terminal assembly is formed by stamping and forming such that each terminal is formed so as to have a body portion 6 (synonymous with the contact portion 13 illustrated in FIGS. 5–7) interconnected to the carrier strip 4 by means of a joint portion 5, which when cut along line C, defines the solder tail portion 14 of each terminal 3. Each terminal of the arrangement 2 has a tapered free-end 7.

The free-end 7 has two opposing angled sides or surfaces 8 converging toward the centerline 10 of each terminal. After completing the mounting of terminals 3 to the housing 1, the carrier strip 4 is cut along the line C (FIG. 12) and is removed from the arrangement of terminals 2. The remaining portion of the joint portion 5 serves as the solder tail portion, which is soldered to a selected conductor on a printed circuit board (not shown).

The housing 1 has positioning pegs 22 on its bottom 21 (FIGS. 4 and 7) so that the electrical connector 1 may be fixed to a printed circuit board with the positioning pegs 22 fitted in the positioning holes of the printed circuit board. The tapered free-end 7 (FIGS. 11–13) of each terminal 3 serves as the mold engagement portion.

As described earlier, the tapered free-end 7 of the terminal 3 has opposing slanted edges or surfaces 8 inclined symmetrically with respect to the centerline 10 between the opposite parallel sides 11 and 12 of the rectangular terminal body. This symmetrical shape of the tapered free-end is advantageous to help in laterally aligning terminals 3 at the correct terminal spacing or pitch P.

In mounting terminals 3 in the connector housing 1, the arrangement of terminals 3 at exact intervals is attained by using appropriate jig means having notches 18 arranged at regular intervals corresponding to the intervals P at which all terminals 3 are to be arranged when mounted in the housing 1. Specifically such jig means is used to keep all terminals 3 arranged at exact intervals P by interdigitally nesting the tapered free-ends 7 of the terminals 3 with the counter notches of the jig means. Without the use of such jig means, the terminal tails 14 are positioned by virtue of their connection to the carrier strip but the mold engagement portions 15 are not positioned because they are free ends. Thus, irregular arrangement or spacing of terminals can be substantially reduced in a forcible manner by the jig means until the terminals 3 are put in correct position. Such jig means is preferably provided in the form of a series of notches in either one of the mold parts 16 and 17. (FIG. 13) The array of terminals 3 is placed between the two mold parts 16 and 17 with the tapered free-end 7 of each terminal 3 fitted in the corresponding notch in the mold part prior to injection molding, thereby assuring arrangement of all terminals 3 at exact intervals P, which is effective in maintaining very small pitches, such as 0.625 mm or the like.

Figure 13:
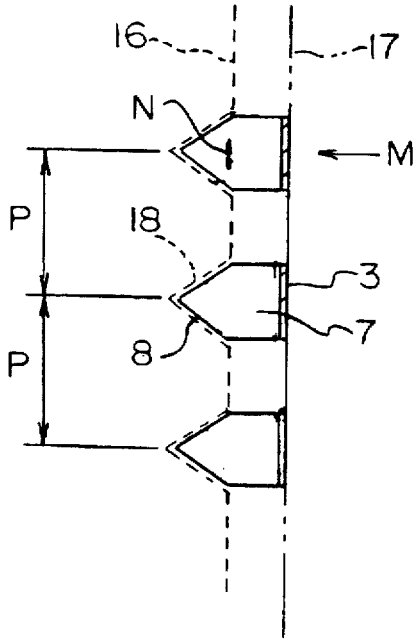
FIG. 13 is a longitudinal section of the terminals of FIG. 12 taken along the line X—X thereof after positioned in place within the mold blocks.

The method of making electrical connectors having small pitch terminals according to the present invention will now be described. As shown in FIG. 13, two mold parts 16 and 17 are used for molding insulative connector housings 1 as is known in the art. An array 2 of terminals 3 (FIG. 12) having been previously stamped and formed as described above is placed between the mold parts 16 and 17, and an insulative material, such as plastic, is injection-molded therearound. Thereafter, the mold parts 16 and 17 are removed to leave an electrical connector having the arrangement 2 of terminals 3 arranged at regular intervals P and embedded in the insulation housing 1. As described above, one of the inside and outside mold parts 16 and 17 (outside mold part 16 in FIG. 13) has a series of notches 18 spaced at regular intervals corresponding to the interval P at which the arrangement 2 of terminals 3 are to be set.

Figure 14:
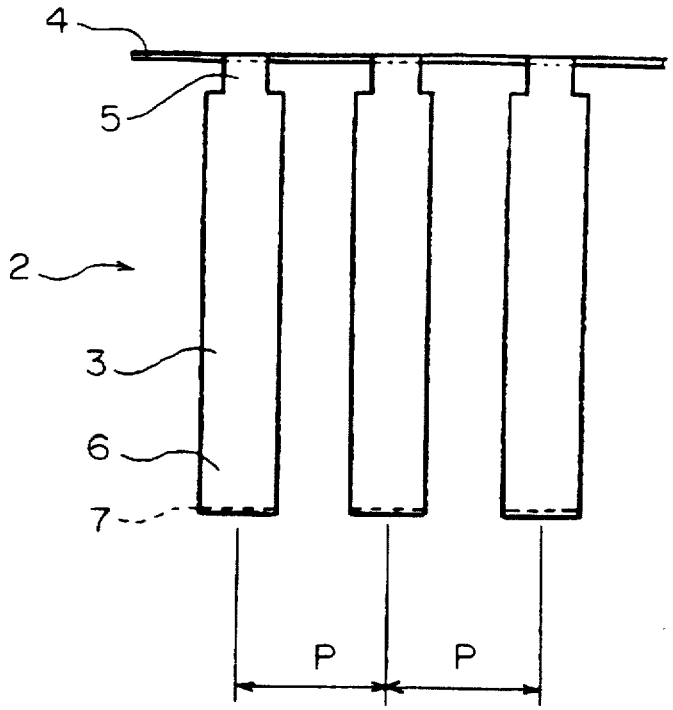
FIG. 14 is a front view of terminals as seen in the direction indicated by arrow M in FIG. 13.

The array 2 of terminals 3 is connected to its associated carrier strip 4, and each terminal 3 has a tapered free-end 7 corresponding in shape and size to the notch 18 made in the mold block 16. The terminal arrangement 2 is placed between the mold block 16 and 17 with the tapered free-end 7 of each terminal 3 fitted in the corresponding notch 18 in the mold part 16 prior to injection molding. Simultaneously, the notchless mold block 17 (shown on the inside of FIG. 13) pushes all of the terminals 3 against the notched mold block 16, thereby forcibly reducing any deviations N which may occur by providing a force M as indicated by arrow M in FIG. 13, to thus arrange all of the terminals 3 at their intended pitch intervals P as seen in FIG. 14.

Whereas the terminal tail portions 14 are positioned by means of their connection to the carrier strip 4, the mold engagement portions 15 (by way of their free ends 7) are now positioned with the notched mold block 16 and held thereagainst by mold block 17. This corrective arrangement can be performed at an increased efficiency, and accordingly, highly precise electrical connectors can be produced more efficiently.

Figure 8:
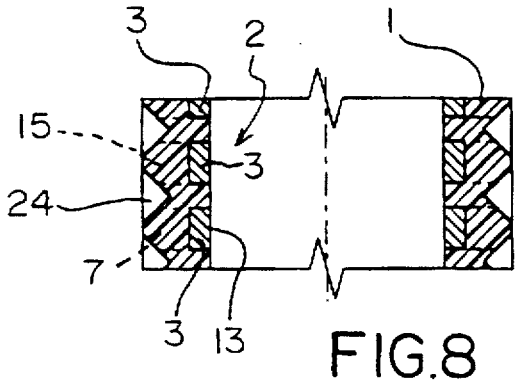
FIG. 8 is a longitudinal section of a portion of electrical connector of FIG. 6 taken along the line J—J thereof.
Figure 9:
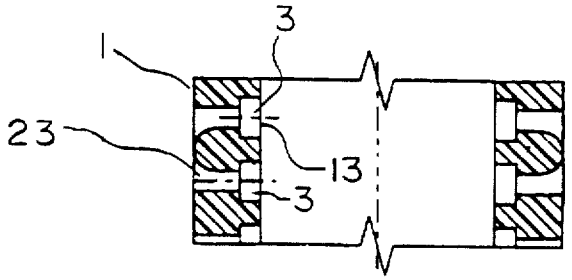
FIG. 9 is a longitudinal section of a portion of electrical connector of FIG. 6 taken along the line K—K thereof.
Figure 10:
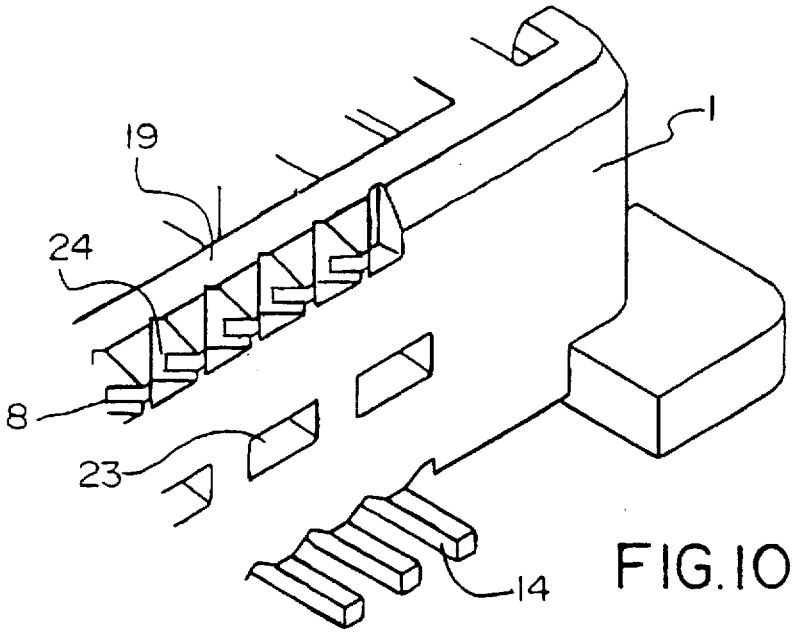
FIG. 10 is an enlarged perspective view of a portion of electrical connector of FIG. 1.

The notched mold 16 may have a series of projections (not shown) formed thereon to properly position and support the terminals 3 prior to and during molding. These mold projections form a series of holes 23. These holes 23 can be used for testing the terminals 3 if desired. FIGS. 8 and 10 illustrate the shape of the insulative housing 1 made by using an outer mold 16 having a series of notches 18 and an inner mold 17 having no notches. The resultant notches 24 are formed in the connector housing 1 as a result of the configuration of the mold block 16 and have no adverse effect on the function of the electric connector. Since the notches 18 of the mold engage the slanted edges 8 of terminal engagement portions 15, substantially no plastic is molded onto these edges. There is, however, plastic above and below the engagement portions 15.

In this particular embodiment, the electrical connector is described as a receptacle, but it may be a plug-style electrical connector. The tapered free-end of the terminal is described above as converging toward the center line 10, thus defining two opposing slanted edges extending from the opposing parallel sides 11 and 12 of the terminal rectangular body. The tapered free-ends of the terminals, however, may also have a single slanted edge inclining from one of its opposing parallel sides 11 and 12 of the terminal rectangular body and traversing the centerline 10 and ending at the other parallel side of the terminal rectangular body. The single inclined edge can be formed more easily than the double angled edge in the tapered end of the terminal. In addition, other tapered surfaces such as arcuate, stepped or other shapes that would accurately guide and position the tapered ends into the recesses in the mold could be used.

As may be understood from the above, terminals according to the present invention have tapered free-ends formed so as to be complimentary in shape to counter notches made in either of the inner and outer molds, thereby permitting corrective adjustment of terminals thus to arrange them at exact intervals in injection molding.

We claim:

1. An electrical connector comprising:

an insulative housing having a pair of spaced apart, generally parallel sidewalls;

a plurality of terminals mounted in said housing generally along the length of said housing sidewalls, said terminals being generally parallel and spaced apart a predetermined distance; and each terminal including a first end for interconnection to an electrical component, a second opposite end positioned within said housing, and a terminal body portion between said first and second ends, each said second end having a tapered portion adapted for engagement with a correspondingly shaped recess in a mold component to maintain said terminal second ends in a predetermined array, said predetermined distance apart in order to maintain said terminal body portions in a generally parallel array and spaced apart said predetermined distance prior to overmolding said housing about said terminals whereby said tapered portions assist in aligning said terminals at said predetermined distance.

2. The electrical connector as defined in claim 1, wherein each of said terminal body portions has two generally parallel sides which define a width of each of said terminals, and each of said second ends has at least one tapered end edge extending from one of said body portion sides towards a centerline of said terminal.

3. The electrical connector as defined in claim 2, wherein substantially no plastic is molded onto said tapered end edge of said second end upon overmolding said housing about said terminals.

4. The electrical connector as defined in claim 2, wherein each of said terminal second ends includes two tapered end edges extending from said generally parallel sides of said body portions toward said terminal centerline.

5. The electrical connector as defined in claim 4, wherein said two tapered end edges converge and intersect with each other generally at said centerline to define said tapered second end of said terminals.

6. The electrical connector as defined in claim 5 wherein said first end is a solder tail for solder interconnection to circuitry of an electronic circuit.

7. The electrical connector as defined in claim 1, wherein each of said terminal second ends has two generally parallel sides and at least one tapered end edge extending from one of said second end sides towards a centerline of said second end.

8. The electrical connector as defined in claim 7, wherein substantially no plastic is molded onto said tapered end edge of said second end upon overmolding said housing about said terminals.

9. The electrical connector as defined in claim 8, wherein each of said terminal second ends includes two tapered end edges extending from said generally parallel sides of said second ends toward said centerline.

10. The electrical connector as defined in claim 9, wherein said two tapered end edges converge and intersect with each other generally at said centerline to define said tapered portion of said second end of said terminals.

11. The electrical connector as defined in claim 1, wherein said body portion of each terminal is generally rectangular and said first and second ends are generally parallel.

12. The electrical connector as defined in claim 11, wherein said first and second ends extend away from said terminal body portions.

13. The electrical connector as defined in claim 1, wherein said housing includes a series of projections extending from said housing sidewalls and generally conforming to the shape of said tapered portion of said second end of said terminals.

14. The electrical connector as defined in claim 13, wherein substantially no plastic is molded onto said tapered end edge of said second end upon overmolding said housing about said terminals.

15. An improved electrical connector, comprising an elongated insulative housing having two opposing sidewalls, a series of electrical terminals spaced apart along said sidewalls of said housing in a predetermined, generally parallel array, said terminals being spaced apart by a predetermined pitch, each of said terminals including a solder tail portion disposed at one end thereof extending away from said housing, a mold engagement portion disposed at an opposite end of said terminal and a body portion interconnecting said solder tail and said mold engagement portions, said mold engagement portion being angularly disposed with respect to said body portion and including a tapered end portion adapted to be received in a complementary notch formed in a mold component for maintaining said mold engagement portions in an array spaced apart by said predetermined pitch prior to overmolding said housing about said terminals, said terminal body portions also being spaced apart by said predetermined pitch within said connector.

16. The connector as defined in claim 15, wherein said housing includes a series of projections extending from said sidewall of said housing and generally conforming to the shape of said tapered end portion of said terminals, and substantially no plastic is molded onto end edges of said tapered end portion upon overmolding said housing about said terminals.

17. An electrical connector comprising:

an insulative housing having a pair of spaced apart, generally parallel sidewalls each having an exterior surface;

a plurality of terminals mounted in said housing generally along the length of said housing sidewalls, said terminals being generally parallel and spaced apart a predetermined distance; and each terminal including a first end for interconnection to an electrical component, a second opposite end positioned within said housing, and a terminal body portion between said first and second ends, each said second end having a tapered portion flush with a generally correspondingly tapered portion of said exterior surface of a respective one of said sidewalls, a portion of said second end being overmolded in said housing.

* * * * *